US006723911B2

(12) United States Patent
Muramatsu et al.

(10) Patent No.: US 6,723,911 B2
(45) Date of Patent: Apr. 20, 2004

(54) PERFORMANCE APPARATUS

(75) Inventors: Shigeru Muramatsu, Mori-machi (JP); Yasutoshi Kaneko, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 10/442,103

(22) Filed: May 21, 2003

(65) Prior Publication Data

US 2003/0217637 A1 Nov. 27, 2003

(30) Foreign Application Priority Data

May 24, 2002 (JP) ..... 2002-150428

(51) Int. Cl.[7] ..... G10H 3/00
(52) U.S. Cl. ..... 84/723; 84/94.1; 84/402
(58) Field of Search ..... 84/94.1–95.2, 84/363, 402, 408–410, 723

(56) References Cited

U.S. PATENT DOCUMENTS 3,652,955 A * 3/1972 Cruger et al. ..... 331/116 M
3,693,491 A * 9/1972 Creager ..... 84/402

* cited by examiner

*Primary Examiner*—Jeffrey Donels
(74) *Attorney, Agent, or Firm*—Dickstein, Shapiro, Morin & Oshinsky, LLP.

(57) ABSTRACT

There is provided a performance apparatus which is capable of performing fine variable control of musical tone parameters so as to obtain a variety of sounding characteristics. A plurality of reeds are fixedly mounted on a center block and each excited to vibrate by a corresponding actuator. A plurality of, e.g. three, resonant plates of different sounding volume are arranged in layers and each provided with a short yoke. A plurality of, e.g. three, vibration transmission mechanisms are fixed on a lower surface of the center block in association the respective resonant plates, and each comprised of a clutch coil wound around a clutch yoke. A CPU controls the supply of driving current to a selected one of the vibration transmission mechanisms according to performance data so that the selected vibration transmission mechanism operates, and when the clutch yoke of the operating vibration transmission mechanism adsorbs the short yoke, the center block and the corresponding resonant plate are brought into a coupled state through the vibration transmission mechanism, whereby vibration of any of the reeds is transmitted from the center block to the resonant plate through the vibration transmission mechanism, to cause the resonant plate to vibrate.

8 Claims, 12 Drawing Sheets

PERFORMANCE APPARATUS

BACKGROUND OF THE INVENTION

1. Field of the Invention

The present invention relates to a performance apparatus that generates sound by transmitting the vibration of at least one vibration generating part to sound boards.

2. Description of the Related Art

Conventionally, a performance apparatus, such as a music box, that vibrates vibration generators such as reeds, transfers the vibration of the vibration generators to sound boards, to thereby generates sound is known. Also, a performance apparatus which is provided with an adjusting device disposed between each vibration generator and its associated sound board and allows the area of contact between the two parts to be manually adjusted, and thus volume and the like are adjustable is known.

However, these conventional performance apparatuses only change the area of contact between the vibration generator and the sound board and hence can only allow sounding characteristics such as change in volume to be simply changed. Thus, the conventional performance apparatuses remain to be improved so as to enable a variety of sounding characteristics to be obtained by finer variable control of tone color and volume.

SUMMARY OF THE INVENTION

It is an object of the present invention to provide a performance apparatus which is capable of performing fine variable control of musical tone parameters so as to obtain a variety of sounding characteristics.

To attain the above object, the invention provides a performance apparatus comprising at least one vibration generating part that generates vibration, a plurality of sound boards, a plurality of vibration transmission mechanisms interposed between respective ones of the plurality of sound boards and the vibration generating part in association with the respective ones of the plurality of sound boards, the plurality of vibration transmission mechanisms being operable to bring respective associated ones of the sound boards and the vibration generating part into a coupled state, to thereby transmit vibration of the vibration generating part to the respective associated ones of the sound boards, and an instruction device that gives an instruction selectively to one of the plurality of vibration transmission mechanisms to operate, whereby vibration of the vibration generating part is transmitted to one of the sound boards that is coupled to the vibration generating part, to cause the one of the sound boards to vibrate to generate sound.

With this arrangement, one of the plurality of vibration transmission mechanisms, to which the instruction have been given, are operable to bring respective associated ones of the sound boards and the vibration generating part into a coupled state, whereby vibration of the vibration generating part is transmitted to one of the sound boards that is coupled to the vibration generating part, to cause the one of the sound boards to vibrate to generate sound. Accordingly, sounding characteristics can be changed variously.

Preferably, the performance apparatus comprises a plurality of magnetic parts each provided on one of the vibration generating part and a corresponding one of the sound boards, and wherein the plurality of vibration transmission mechanisms each comprise one end and another end, the one end of each of the vibration transmission mechanisms is fixedly mounted on the one of the vibration generating part and the corresponding one of the sound boards, the other end of each of the vibration transmission mechanisms is disposed in proximity to a corresponding one of the magnetic parts, whereby each of the vibration transmission mechanisms operates in response to the instruction from the instruction device, for having the other end thereof electromagnetically attracts the corresponding one of the magnetic parts, to bring the vibration generating part and the corresponding one of the sound boards into the coupled state.

Preferably, the performance apparatus comprises a plurality of damping parts, and wherein the other end of each of the vibration transmission mechanisms and the corresponding one of the magnetic parts have respective parts which face each other, and one of the damping parts is provided on at least one of the other end of each of the vibration transmission mechanisms and the corresponding one of the magnetic parts.

Preferably, in the performance apparatus, the vibration generating part is operable based on performance data, for generating vibration, and the instruction device is responsive to a predetermined command corresponding to the performance data, for giving the instruction.

Preferably, in the performance apparatus, the instruction device gives the instruction to each of the vibration transmission mechanisms to change strength of coupling of the vibration generating part and the corresponding one of the sound boards so as to adjust sounding volume.

Preferably, in the performance apparatus, the instruction device gives the instruction to each of the vibration transmission mechanisms to change with time a degree of coupling of the vibration generating part and the corresponding one of the sound boards so as to provide a modulation effect while the vibration generating part is generating vibration.

Preferably, the performance apparatus further comprises an operation element operatable for causing the instruction device to give the instruction.

Preferably, in the performance apparatus, when the instruction device gives instructions to the plurality of vibration transmission mechanisms to operate, the plurality of vibration transmission mechanisms are operated simultaneously to resonate a plurality of corresponding sound boards at the same time.

The above and other objects, features, and advantages of the invention will become more apparent from the following detailed description taken in conjunction with the accompanying drawings.

BRIEF DESCRIPTION OF THE DRAWINGS

wherein FIG. 5A is a view showing initial positions of the essential parts of the actuator;

FIGS. 5B to 5G views showing positions of the essential parts during reciprocating motion of a plunger and a hook part constituting the essential parts; and FIG. 5H is a view showing a state in which the plunger and the hook part have returned to the initial positions;

DETAILED DESCRIPTION OF THE PREFERRED EMBODIMENTS

The present invention will be described below with reference to the accompanying drawings showing preferred embodiments thereof.

Figure 1:
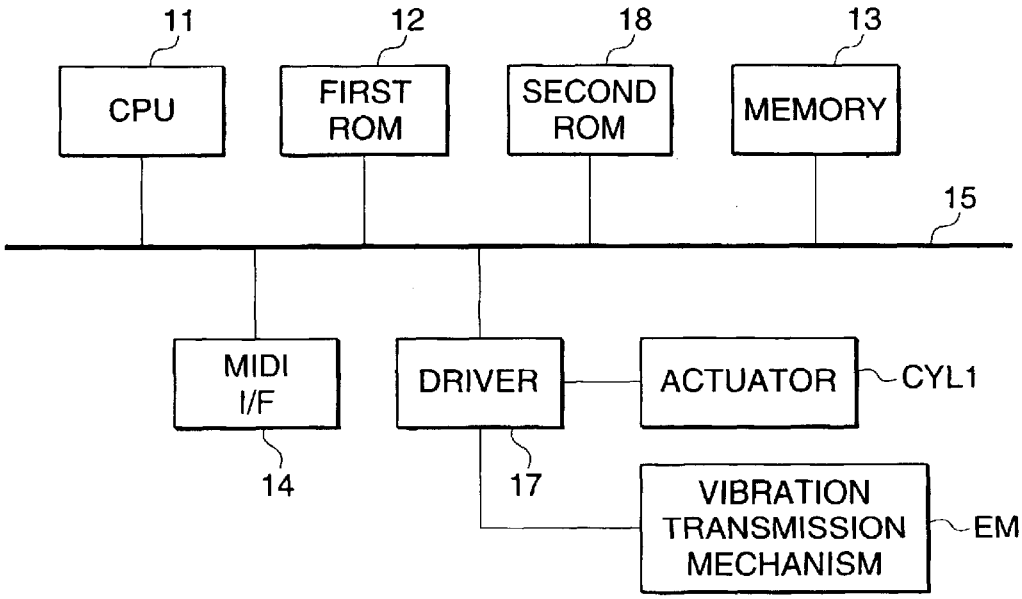
FIG. 1 is a block diagram showing the construction of a control mechanism of a performance apparatus according to a first embodiment of the present invention.

FIG. 1 is a block diagram showing the construction of a control mechanism of a performance apparatus according to a first embodiment of the present invention.

The apparatus is constructed such that a first ROM 12, a memory 13, a MIDI interface (MIDI/IF) 14, a second ROM 18, and a driver (PWM) 17 are connected to a CPU 11 via a bus 15. The CPU 11 is in charge of overall control of the apparatus. The first ROM 12 is comprised of a program ROM, a data ROM, and a working ROM, which are not shown, and stores control programs to be executed by the CPU 11, various data, and so on. The MIDI I/F 14 inputs performance data from a MIDI instrument, not shown, or the like, as MIDI (Musical Instrument Digital Interface) signals. The memory 13 is comprised of a RAM or the like, and can store performance data including performance data input from the MIDI I/F 14. The second ROM 18 stores a parameter table and the like. The driver 17 drivingly controls actuators CYL1 and vibration transmission mechanisms EM as described hereinafter.

Figure 2:
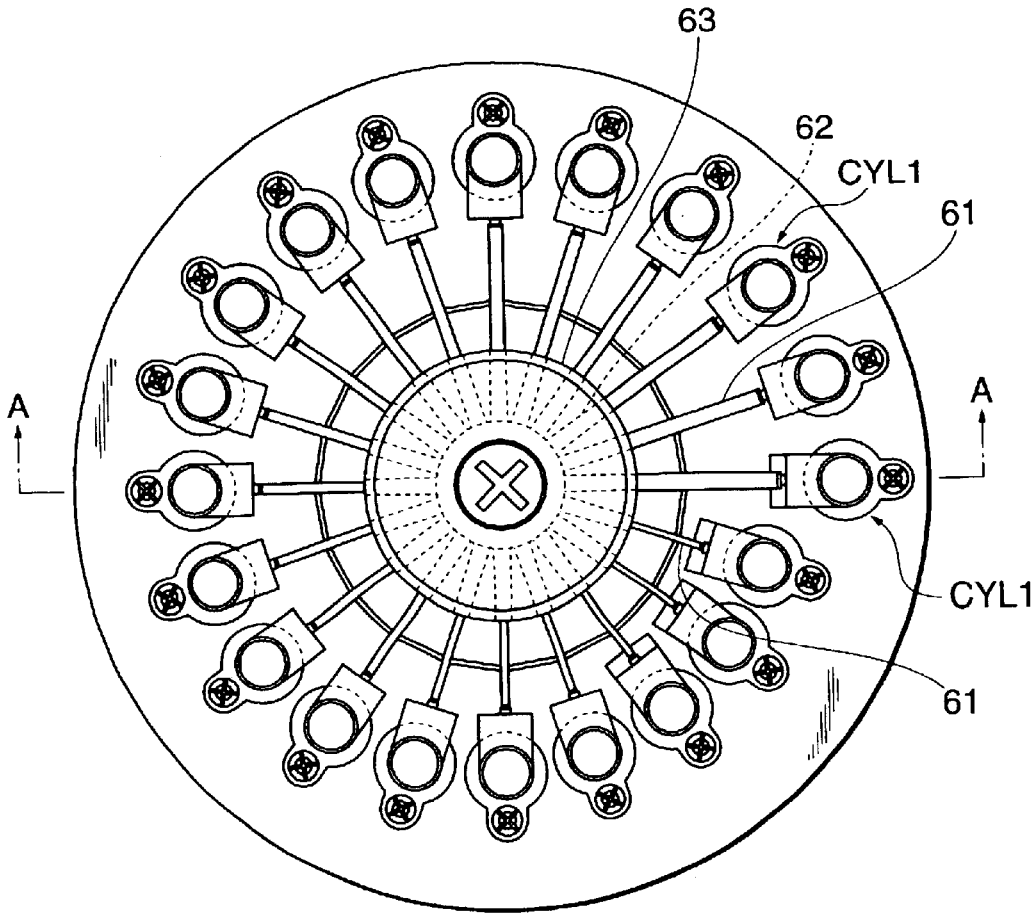
FIG. 2 is a top plan view of the performance apparatus according to the first embodiment.
Figure 3:
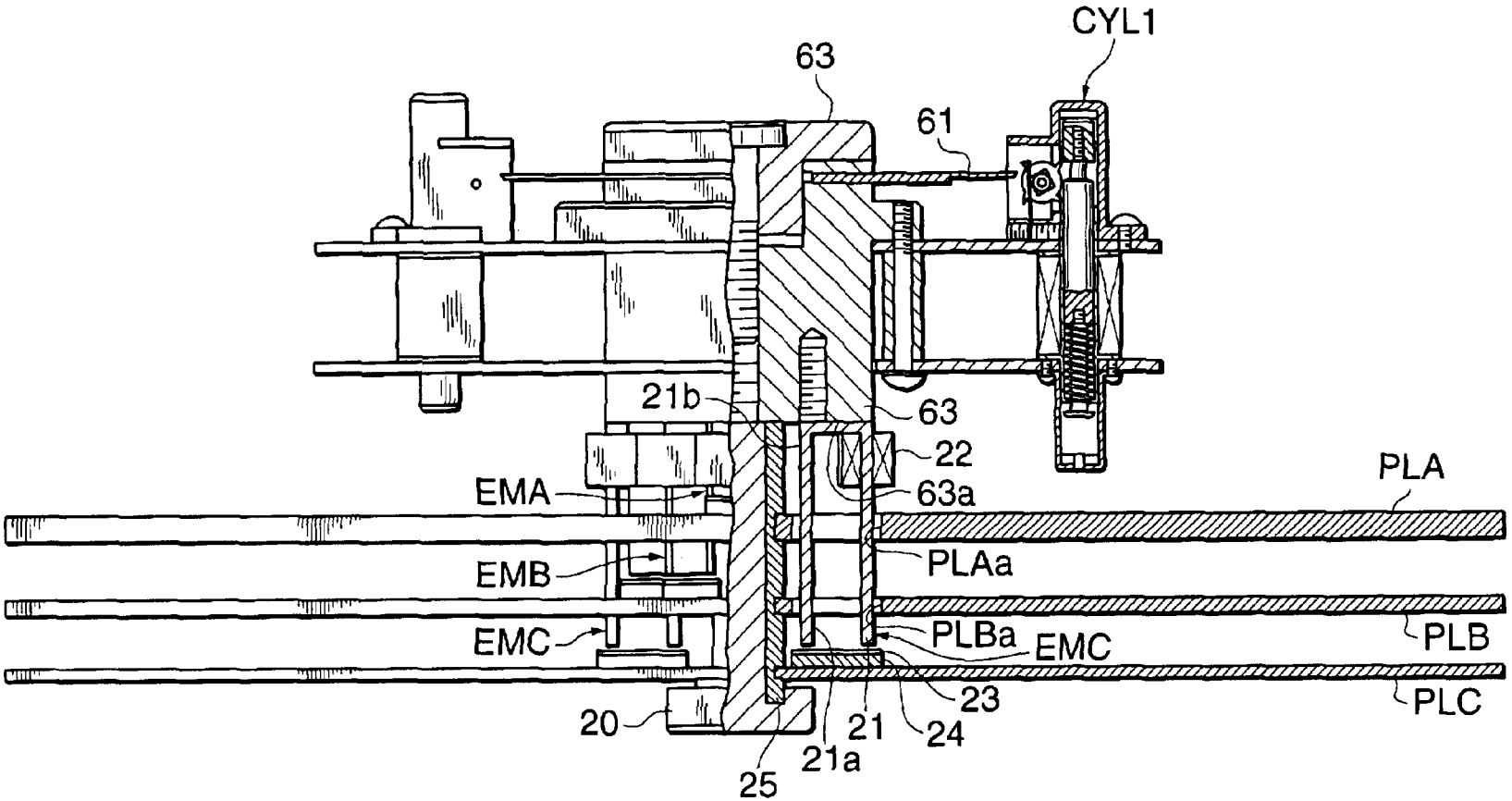
FIG. 3 is a sectional view taken along line A—A in FIG. 2.
Figure 4A:
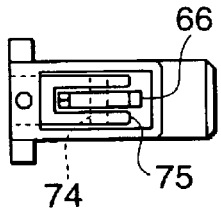
FIG. 4A is a view as viewed from an arrow F1 in FIG. 4B.
Figure 4B:
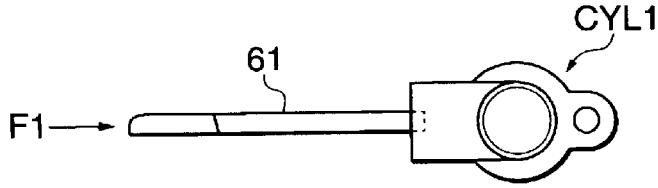
FIG. 4B is a top plan view showing an upper part of an actuator.
Figure 4C:
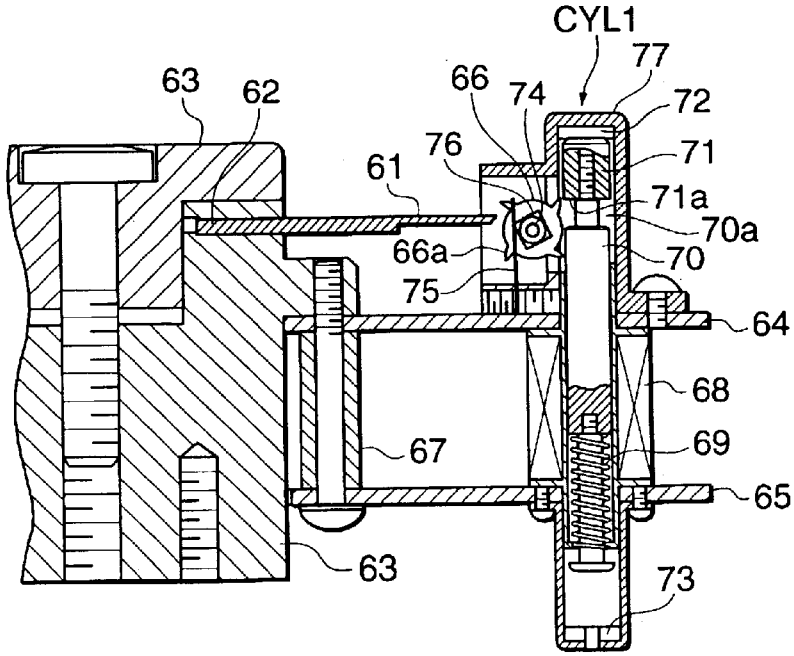
FIG. 4C is a fragmentary sectional view taken along line A—A in FIG. 2, showing in detail a vibration generating part and its associated parts.

FIG. 2 is a plan view of the performance apparatus according to the present embodiment, and FIG. 3 is a sectional view taken along line A—A in FIG. 2. In FIG. 2, resonant plates PLA, PLB, and PLC, described hereinafter are not shown. FIG. 4C is a fragmentary sectional view taken along line A—A in FIG. 2, showing in detail a vibration generating part and its associated parts. FIG. 4B is a plan view of an upper part of an actuator CYL1, and FIG. 4A is a view as viewed from an arrow F1 in FIG. 4B.

As shown in FIG. 2 and FIG. 4C, a base end part 62 of each of a plurality of e.g. 20) reeds 61 is fixed to a center block 63, and each reed 61 extends from the base end 62. Each reed 61 extends radially outward on a plane.

A plurality of actuators CYL1 are provided in association with the respective reeds 61. As shown in FIG. 4C, each actuator CYL1 is comprised of a solenoid coil 68, a plunger 70, a plunger spring 69, a hook part 71, an upper yoke 64, a lower yoke 65, and others. The upper yoke 64 and the lower yoke 65 are shared by all the actuators CYL1 to simplify the construction. Specifically, the upper yoke 64 and the lower yoke 65 are each shaped in the form of a disk, and attached to the center block 63 almost in parallel with each other with a proper distance maintained therebetween by a yoke spacer 67. Although in the present embodiment, the actuators CYL1 are darranged in a spiral array due to differences in length between the reeds 61, the base ends 62 may be individually disposed in such respective different positions such that the actuators CYL1 are darranged in a circular array.

The solenoid coil 68 is disposed between the upper yoke 64 and the lower yoke 65. The plunger 70 is disposed inside the solenoid coil 68, for reciprocating motions in the vertical direction. Under the plunger 70, the plunger spring 69 is disposed to permanently apply an upward bias force to the plunger 70. When a driving current is supplied to the solenoid coil 68, a magnetic force is generated to move the plunger 70 downward. When the driving current is cut off, the plunger 70 moves upward and returns to an original initial position by the bias force given by the plunger spring 69.

On top of the plunger 70, the hook part 71 is mounted so as to define a channel-shaped stepped part 70*a* between the hook part 71 and the plunger 70. A lower end of the hook part 71 that faces the channel-shaped stepped part 70*a* serves as an engaging part 71*a*, described hereinafter. In an upper part and an lower part of a cylinder 77 in which the plunger 70 is slidably fitted, an upper cushion part 72 and a lower cushion part 73 are respectively provided to absorb shock generated by the reciprocating motion of the plunger 70.

A rotary pick 66 is provided for each reed 61 and disposed in the vicinity of a radially outer end of the reed 61. The rotary pick 66 has an outer peripheral surface thereof formed integrally with a plurality (four for example) of driving nails 66*a* (66*a*1 to 66*a*4 in FIG. 5A). Rectangular cam parts 76 are fixedly mounted on opposite end faces of the rotary pick 66 to prevent reverse rotation of the same, and a cam spring 75 is disposed in closely facing relation to the rotary pick 66. The driving nails 66*a* receive a driving forceforce from the engaging part 71*a* of the channel-shaped stepped part 70*a*, whereby the rotary pick 66 rotates about a rotary shaft 74. As described hereinafter, the cam parts 76 and the cam spring 75 cooperate to rotate the rotary pick 66 substantially only in one direction (clockwise as viewed in FIG. 4C).

The cam spring 75 is formed of an elastic sheet material such as a metal sheet and has a U-shaped configuration, as shown in FIG. 4A. The cam spring 75 has one end thereof secured to the body of the apparatus, and has a portion from an intermediate part to the other end which is bifurcated, i.e. has two separated portions, and the two separated portions sandwiches the rotary pick 66 therebetween to impart a bias force to the cam part 76 in a direction away from the reed 61. Each cam part 76 has four corners thereof rounded off in an arcuate shape.

The above-mentioned "vibration generating part" for vibrating the reed 61 is comprised of the reed 61, the actuator CYL1, the rotary pick 66 and the cam spring 75, and the like.

Figure 5A:
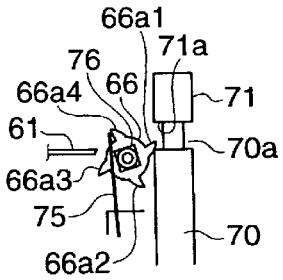
FIGS. 5A to 5H are views showing successive changes in motion of essential parts of the actuator.
Figure 5B:
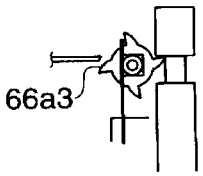
Figure 5C:
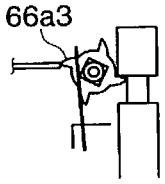

FIGS. 5A to 5H are views showing successive changes in motion of essential parts of the actuator CYL1. First of all, as shown in FIG. 5A, in the initial state, one of the driving nails, 66*a*1 in the illustrated example, of the rotary pick 66 engages in the channel-shaped stepped part 70*a*. Next, when the solenoid coil 68 is energized, the plunger 70 (and the hook part 71) starts to move downward, then the engaging part 71*a* is brought into contact with the driving nail 66*a*1 (in FIG. 5B), the rotary pick 66 rotates clockwise, and the driving nail 66*a*3 located symmetrically to the driving nail 66*a*1 engaged with the engaging part 71*a*, flips the tip of the reed 61, thereby producing sound (in FIG. 5C). On this occasion, the direction of a rotative driving force applied to the rotary pick 66 due to a reaction force of the cam spring 75 through the cam parts 76 temporarily becomes counterclockwise. However, as a clockwise rotative driving force applied by the engaging part 71*a* surpasses the above counterclockwise rotative driving force, the rotary pick 66 does not rotate counterclockwise.

Figure 5D:
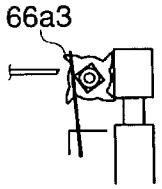
Figure 5E:
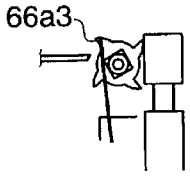
Figure 5F:
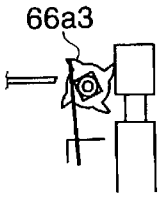
Figure 5G:
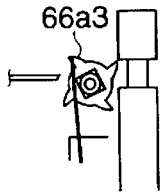

As the plunger 70 further moves downward, the driving nail 66*a*3 which has flipped the reed 61 departs from the reed 61, and thereafter the direction of the rotative driving force applied to the rotary pick 66 due to the reaction force of the cam spring 75 becomes clockwise again (in FIG. 5D). Then, the plunger 70 reaches a descending end position, namely, a bottom dead point (in FIG. 5E).

Next, when the solenoid coil 68 is fdeenergized, the plunger 70 starts to move upward due to a reaction force of the plunger spring 69. However, as the clockwise rotative driving force is still applied to the rotary pick 66 by the cam spring 75, it is impossible for the rotary pick 66 to rotate counterclockwise even when the plunger 70 moves upward (in FIG. 5F).

Figure 5H:
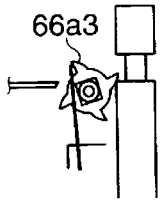

When the plunger 70 further moves upward and returns to a position in the vicinity of the initial position such that the channel-shaped stepped part 70*a* comes to face the driving nail 66*a*4 of the rotary pick 66 (in FIG. 5G), the rotary pick 66 rotates clockwise by the clockwise rotative driving force of the cam spring 75 so that the driving nail 66*a*4 gets into the channel-shaped stepped part 70*a*, and thus the plunger 70 returns to the initial state (in FIG. 5H). In the above described way, a sound producing operation process for producing sound once by exciting the reed 61 is carried out.

As described above, each reed 61 independently vibrates in arbitrary timing by being flipped by the driving nails 66*a* of the rotary pick 66, thereby producing sound. However, large-volume fine sound cannot be produced only by vibration of each reed 61. Therefore, in the present embodiment, as described below, the resonant plates PLA, PLB, and PL are provided such that vibration of the reeds 61 is transmitted to the resonant plates PLA, PLB, and PLC through the vibration transmission mechanisms EM so that sound large in volume can be produced.

As shown in FIG. 3, below the center block 63, the resonant plates PLA, PLB, and PLC, which are disk-shaped, are disposed in layers in this order from the top. The center block 63 is in fixed positional relationship with a plate center shaft 20, and the resonant plates PLA, PLB, and PLC are supported at their respective center parts by a plate holder 25 fixed to the plate center shaft 20. The plate holder 25 is made of hard rubber or elastomer or the like so as to block vibration transmission between the plate center shaft 20 and the resonant plates PLA, PLB, and PLC.

The resonant plates PLA, PLB, and PLC are made of, for example, metal, and their thickness relationship is set at PLA>PLB>PLC. In general, the thicker a resonant plate, the less it is prone to vibrate, and accordingly the amplitude of sound is smaller and the sounding volume is lower. Therefore, the sounding volume relationship is PLA<PLB<PLC.

On a lower surface 63*a* of the center block 63, vibration transmission mechanisms EMA, EMB, and EMC are mounted in association with the resonant plates PLA, PLB, and PLC. The vibration transmission mechanism EMA, EMB, and EMC, are each comprised of a plurality of, e.g. two, symmetrical bodies having the same construction and arranged symmetrically with respect to the plate center shaft 20. Taking the case of the vibration transmission mechanism EMC and elements associated therewith, the resonant plates PLA and PLB are provided with holes PLAa and PLBa, respectively, and the corresponding body of the vibration transmission mechanism EMC is pending downwar through the holes PLAa and PLBa. The resonant plates PLA and PLB have basically the same construction as the resonant plate PLC, and holes through which the body of the vibration transmission mechanism EMB penetrates are provided only through the resonant plate PLA, and no hole for penetration is provided for the vibration transmission mechanism EMA because the mechanism EMA is located at the highest location with its lower end always the resonant plate PLA which is the highest in location among the three resonant plates.

Figure 6:
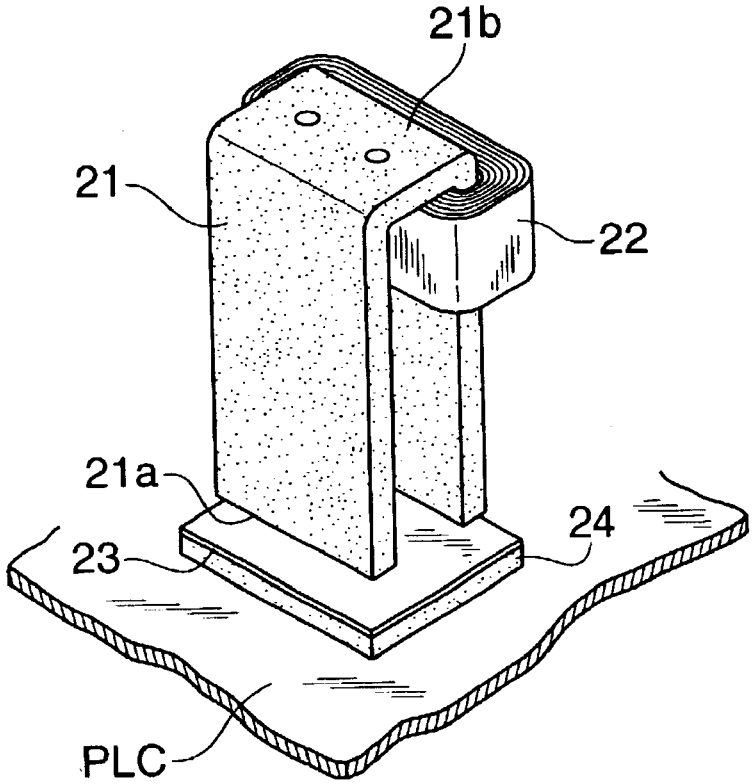
FIG. 6 is a perspective view showing the appearance of essential parts (a vibration transmission mechanism and its associated parts) of the performance apparatus.

FIG. 6 is a perspective view showing the appearance of essential parts (the vibration transmission mechanism EMC and its associated parts) of the performance apparatus. The vibration transmission mechanism EMC is comprised of a yoke (hereinafter referred to as "clutch yoke") 21 which is made of a magnetic material such as soft iron and shaped in the form of a horseshoe or U-shape, and a solenoid coil (hereinafter referred to as "clutch coil") 22 wound around the clutch yoke 21. A top end 21*b* of the clutch yoke 21 is stuck on the lower surface 63*a* of the center block 63.

On the other hand, mounted on the resonant plate PLC, a yoke (hereinafter referred to as "short yoke") 24 (magnetic part), which is made of a magnetic material such as soft iron and shaped in the form of a rectangular plate. A damping plate (damping part) 23 is stuck on the short yoke 24. When the clutch coil 22 is not energized, a lower end 21*a* of the clutch yoke 21 is positioned opposite to and close to the damping plate 23, and the gap therebetween is set to approximately 0.3–0.5 mm.

The CPU 11 operates based on performance data stored in the memory 13 which is input from the MIDI I/F 14, for example, to provide control such that a driving current is supplied to the solenoid coil 68 of the actuator CYL1 that corresponds to a pitch signal of the performance data. Further, the performance data includes a command (predetermined command) for instructing to drive the vibration transmission mechanism EMC, as one of events for example, and responsive to this command, the CPU 1 selectively instructs one of the vibration transmission mechanisms EMA to EMC to operate, by causing a driving current to be supplied to the clutch coil of the one vibration transmission mechanism EMA to EMC. In the present embodiment, one of the vibration transmission mechanisms EMA to EMC operates for each piece of music.

With the above construction, when the clutch coil 22 of the vibration transmission mechanism EMC, for example, is energized, a magnetic force is generated in the clutch yoke 21, so that the clutch yoke 21 causes the short yoke 24 to be magnetically adsorbed thereto. At this time, the damping plate 23 absorbs a shock generated between the clutch yoke 21 and the short yoke 24, to reduce impact noise. The adsorption of the yoke 24 to the yoke 24 causes the center block 63 and the resonant plate PLC to be coupled together through the vibration transmission mechanism EMC, to bring about a vibration transmissible state in which vibration can be efficiently transmitted. Thus, the vibration of the reed 61 is transmitted through the center block 63, the vibration transmission mechanism EMC, and the short yoke 24, to the resonant plate PLC, so that the resonant plate PLC vibrates to generate good sound at high level.

When the current through the clutch coil 22 is cut off, the clutch yoke 21 moves away from the short yoke 24. At this time, the damping plate 23 interposed between the two yokes prevents strong absorption therebetween, so that the clutch yoke 21 and the short yoke 24 quickly move away from each other, whereby the center block 63 and the resonant plate PLC are brought into a non-coupled state. Thus, good response characteristics can be obtained when the yokes are adsorbed together and move away from each other.

More specifically, when the clutch yoke 21 and the short yoke 24 are adsorbed together, the damping plate 23, the short yoke 24, and the resonant plate PLC vertically move together as moving parts. At this time, the plate holder 25 absorbs any slight amount of displacement of the moving parts.

The other vibration transmission mechanisms EMA and EMB, and elements associated therewith are constructed likewise, and the vibration transmission mechanism EMA or EMB operates in response to an operation instruction from the CPU 11, and when the vibration transmission mechanism EMA or EMB are coupled with the corresponding resonant plate PLA or PLB, vibration of the reed 61 is transmitted likewise.

As described above, according to the present embodiment, a plurality of (three) sets of a resonant plate and a vibration transmission mechanism EM are provided, and it is configured such that a resonant plate PL selected based on performance data is connected to the center block 63 by operating the corresponding vibration transmission mechanism EM, whereby vibration is allowed to be transmitted. Thus, resonant plates PL, can be selectively caused to resonate to obtain good sound, and further the volume of sound can be selectively set to at least three levels according to pieces of music.

In the present embodiment, the resonant plates PLA, PLB, and PLC are different only in thickness so as to obtain different levels of sounding volume. However, the resonant plates PL may be different not only in thickness but also in various factors such as size, shape, material, and number, so as to obtain a variety of tone colors and a variety of levels of volume. For example, in general, the larger the area of the resonant plate PL or the smaller the thickness, the larger the volume. Further, the volume also changes with the sonic value of the vibrating material. Provided that Young's modulus is designated by E and Poisson's ratio by $\rho$, the larger the value $E/\rho$, the larger the sonic value, and the volume also increases with an increase in the sonic value. Besides, as regards the relationship between the vibration transmission mechanism EM and the short yoke 24, the area of contact and the contact pressure between the two parts, and further, the location of the vibration transmission mechanism EM also affect the volume and the tone color. Therefore, if all these factors are taken into account in designing the material, shape, and number of resonant plates, and the construction and location of the vibration transmission mechanisms EM, a variety of changes in sounding characteristics including not only volume adjustment but also tone color control can be achieved, allowing the invention to be applied to a wide range of usage.

Further, the vibration transmission mechanism EM may be driven not only for each piece of music, but may be driven in real time for a specific component of a piece of music, such as a note, according to event data. Still further, the coupled state of the center block 63 and the resonant plate PL may be varied with time, for example, by supplying a driving current to the vibration transmission mechanism EM according to a sine wave, to thereby obtain modulation effects of vibrato, tremolo or the like.

Although in the present embodiment, one vibration transmission mechanism EM is selected to operate, that is, one resonant plate PL is selected to resonate, based on performance data, a plurality of vibration transmission mechanisms EM may be operated simultaneously to resonate a plurality of corresponding plates PL at the same time. Further, by providing variations in the strength of the adsorbing force between the vibration transmission mechanisms EM, volume adjustment such as changing the sounding volume for each piece of music may be carried out as desired. By such control, a wider range of changes in sounding characteristics can be realized.

Although in the present embodiment, the vibration transmission mechanism EM is operated according to a command included in performance data, the present invention is not limited to this, and for example, an operating element may be provided so that a user operates the operating element to give a desired operation instruction to a desired vibration transmission mechanism EM.

Although in the present embodiment, the damping plate 23 is mounted on the short yoke 24, the damping plate 23 may be mounted on the lower end 21*a* of the clutch yoke 21 or at both of the short yoke 24 and the lower end 21*a*. Also, although in the present embodiment, the vibration transmission mechanisms EM is mounted on the center block 63 side, and the short yoke 24 is arranged on the resonant plate PL side, conversely, the vibration transmission mechanism EM may be arranged on the resonant plate PL side, and the short yoke may be arranged on the center block 63 side.

Further, the mechanism that brings the center block 63 and the resonant plates into a coupled state is not limited to a magnetic absorption mechanism like the vibration transmission mechanism EM, and any other mechanism that can secure the coupled state while allowing vibration transmission, for example, a mechanism that brings a plunger into contact with the resonant plate side using a solenoid coil, may be employed.

The performance data is not limited to data read out from a ROM or the like, and for example, the performance data may be generated through operation of a key board, a key pad, or the like of an input operating section.

In the present embodiment, after the clutch coil 22 is deenergized so that the clutch yoke 21 moves away from the short yoke 24, the vibration of the resonant plate PL damps spontaneously, but as described below, a damper mechanism may be provided to forcibly damp the vibration.

Figure 7:
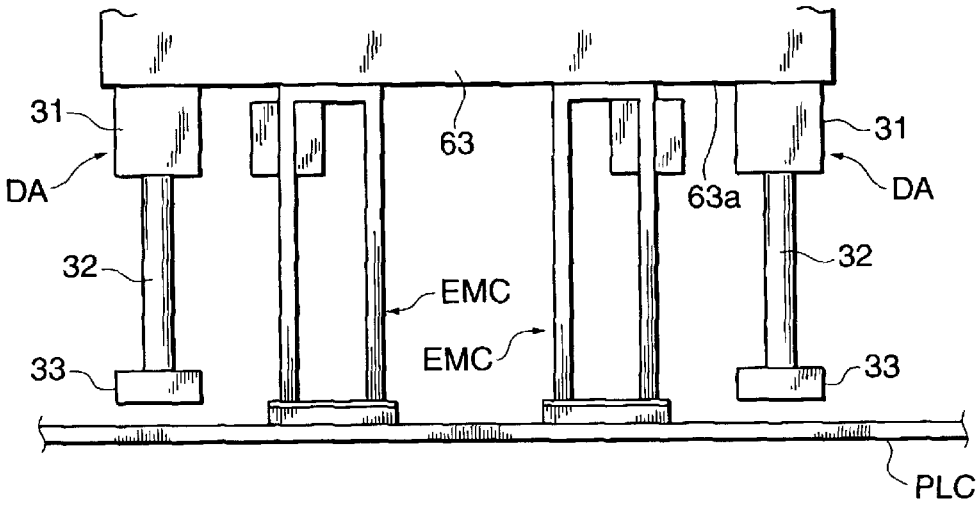
FIG. 7 is a schematic fragmentary view showing, by way of example, the construction of a performance apparatus according to a variation of the first embodiment in which a damper mechanism is additionally provided.

FIG. 7 is a schematic fragmentary view showing, by way of example, the construction of a performance apparatus according to a variation of the above described first embodiment in which a damper mechanism is additionally provided. FIG. 7 shows a case where a damper mechanism is provided for the resonant plate PLC, but such a damper mechanism may be provided for the other resonant plates PL as well.

As shown in FIG. 7, on the lower surface 63*a* of the center block 63, a pluarlity of, e.g. two, damper mechanisms DA are mounted, in addition to the vibration transmission mechanism EMC. The damper mechanisms DA are each comprised of a solenoid coil 31, a rod-shaped member 32 connected to a plunger, not shown, and a pushing member 33 made of felt and mounted on a lower end of the rod-shaped member 32. The pushing member 33 is located in proximity to the resonant plate PLC. A driving current is supplied to the solenoid coil 31 according to end data included in the performance data, for example.

When driving current is supplied to the solenoid coil 31, the rod-shaped member 32 moves downward to bring the pushing member 33 into urging contact with the resonant plate PLC, whereby vibration of the resonant plate PLC is rapidly damped. For example, if vibration of the resonant plate PL is forcibly damped during a time period between pieces of music, unnecessary sound can be prevented from continuing to be generated even after the next piece of music starts to be performed. Further, the pushing member 33 may be operated according to event data included in the performance data, and thus musical tone control can be carried out in various manners.

Next, a second embodiment of the present invention will be described with reference to FIGS. 8 to 10 as well as FIG. 1.

Figure 8:
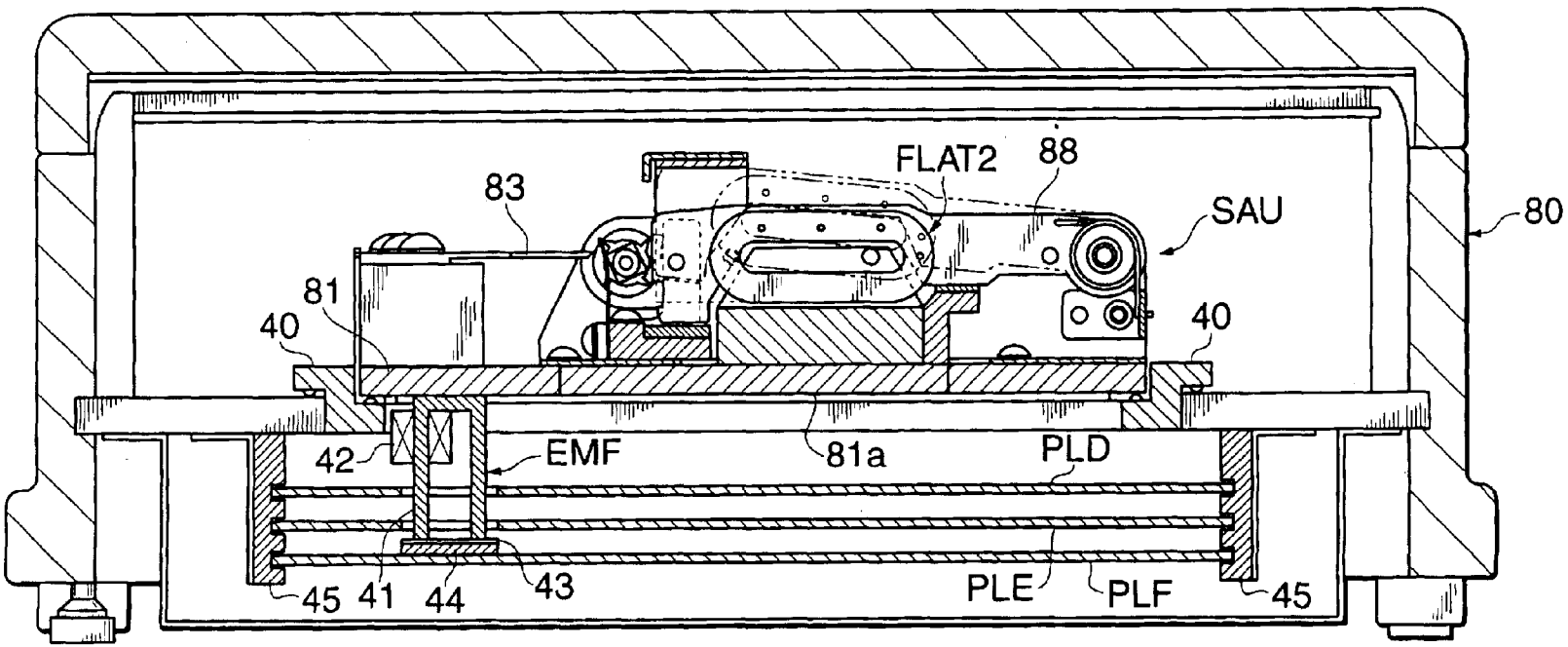
FIG. 8 is a sectional view showing a performance apparatus according to a second embodiment of the present invention.

FIG. 8 is a sectional view of a performance apparatus according to the second embodiment of the invention. The apparatus is provided with a swing arm unit SAU mounted in a housing 80.

In the present embodiment, the construction of the control mechanism is the same as that in the first embodiment, but an actuator FLAT2, which is implemented by a flat coil type, is employed in place of the actuator CYL1.

Figure 9:
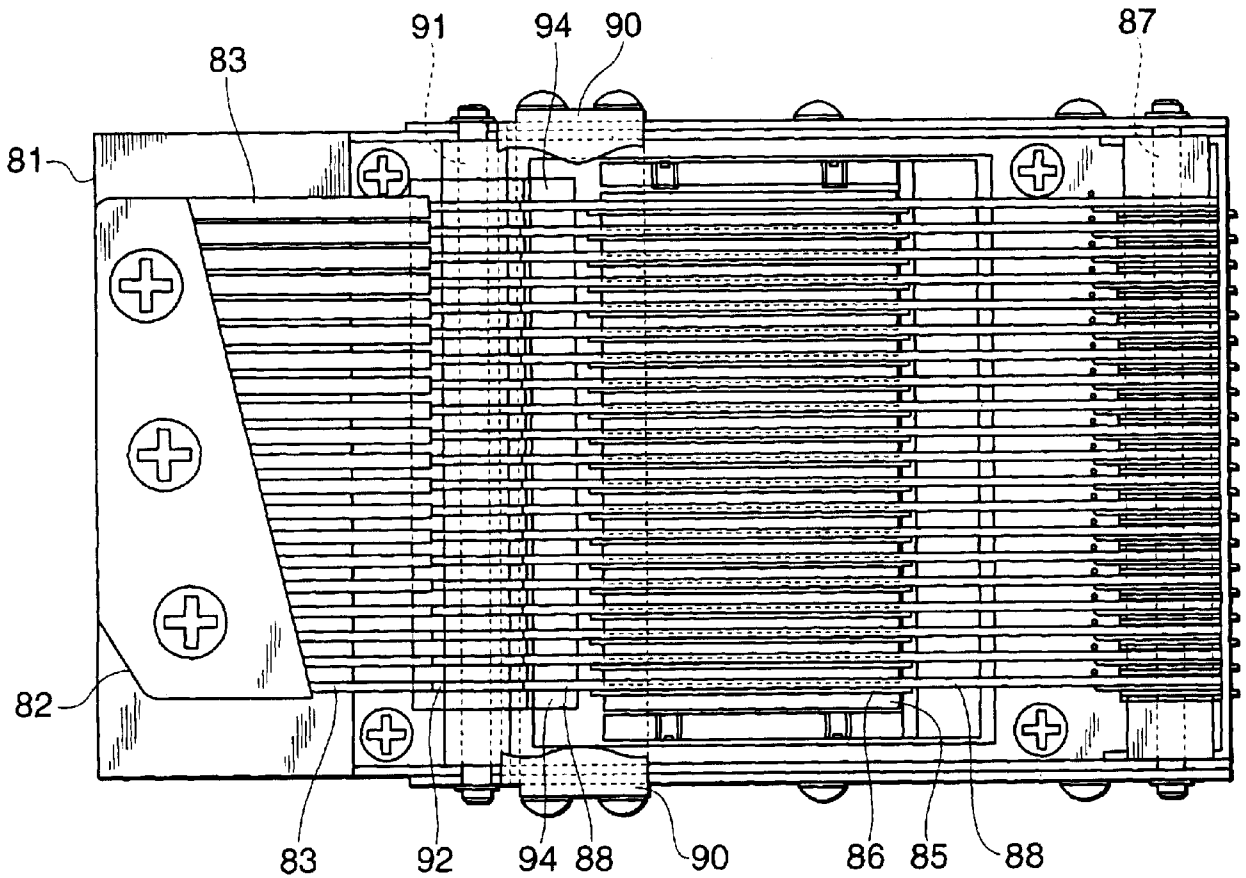
FIG. 9 is a top plan view showing a swing arm unit.
Figure 10A:
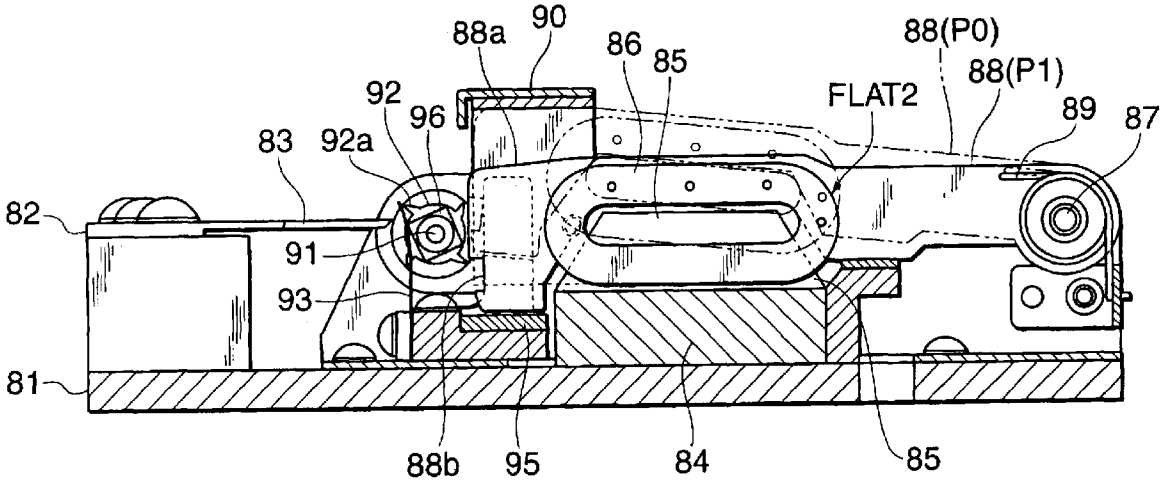
FIG. 10A is a sectional view of the swing arm unit.
Figure 10C:
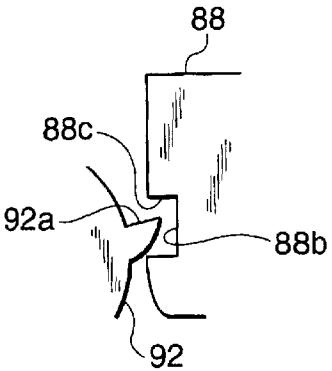
FIG. 10C is a fragmentary enlarged view of a channel-shaped stepped part and its associated parts.
Figure 10B:
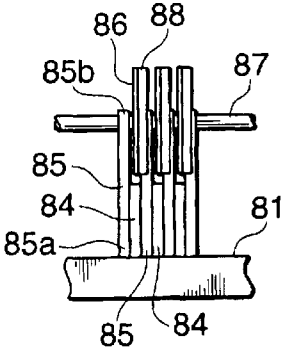
FIG. 10B is a front view showing essential parts of the swing arm unit as viewed from a left side in FIG. 10A.

FIG. 9 is a top plan view of the swing arm unit SAU. FIG. 10A is a sectional view of the swing arm unit SAU, FIG. 10B is a front view showing essential parts of the swing arm unit as viewed from a left side in FIG. 10A, and FIG. 10C is a fragmentary enlarged view of a channel-shaped stepped part and its associated parts.

As shown in FIG. 9, a plurality of reeds 83, which are a plurality of sounding bodies of different sounding pitches, extend in the form of comb teeth from a base end 82 fixed to a base plate 81. Further, rotary picks 92 are disposed in association with the respective reeds 83 in proximity to the tips of the reeds 83.

An actuator FLAT2 is comprised of a plurality of magnets 84, a plurality of yokes 85, a plurality of swing arms 88, a plurality of flat coils 86, and so on, as shown in FIG. 10A. Each of the magnets 84, which are each made of a rare earth magnet such as a neodymium-based magnet, and an associated one of the yokes 85 cooperate to constitute a magnetic field generating unit.

Specifically, the magnets 84 are fixed to the base plate 81 and arranged thereon in association with the respective reeds 83 in a direction in which the reeds 83 are juxtaposed. Each yoke 85 is disposed between adjacent magnets 84 such that the magnets 84 and the yokes 85 are alternately arranged. Each yoke 85 has a low end 85*a* thereof sandwiched between adjacent ones of the magnets 84 and has an upper end 85*b* thereof projecting upward, whereby a magnetic field is formed above the magnets 84 and between the upper ends 85*b* of adjacent yokes 85.

As shown in FIG. 10A, each swing arm 88 has a free end 88*a* thereof disposed to vertically swing about a swing shaft 87. Arranged in proximity to the swing shaft 87 of the swing arm 88 is a swing arm spring 89 which permanently urges the swing arm 88 clockwise as viewed in FIG. 10A. FIG. 10A shows a state in which the swing arm 88 (swing arm 88 (P1)) is being swung. In the initial state, the swing arm 88 is biased by the spring 89 in contact with an upper limit stopper 90 (a position indicated by the swing arm 88 (P0)). A lower limit stopper 95 determines a position in which the swing arm 88 stops to be swung. A side guide 94 is disposed between adjacent swing arms 88 (FIG. 9), which restricts the movement of the swing arms 88 in a lateral direction (the direction in which the reeds 83 are juxtaposed).

Each flat coil 86 is shaped in the form of a plate and mounted on a corresponding swing arm 88. The flat coil 86 is disposed almost parallel with the vertical direction as well as with the longitudinal direction of the reed 83. The flat coil 86 is located in the magnetic filed formed between the upper ends 85*b* of the yokes 85, and when the flat coil 86 is energized, the corresponding swing arm 88 is swung downward according to Fleming's left-hand rule. When the flat coil 86 is deenergized, the corresponding flat arm 88 is urged by the spring 89 to return to the original initial position.

As is the case with the first embodiment, each rotary pick 92 has its peripheral surface formed integrally with a plurality of, e.g. four, driving nails 92*a*, a rectangular cam part 96 is fixedly mounted on opposite end faces of the rotary pick 92, and a cam spring 93 is disposed in closely facing relation to the rotary pick 91. The swing arm 88 has a free end 88*a* thereof formed integrally with a channel-shaped stepped part 88*b*, which is the same as the channel-shaped stepped part 70*a* in the first embodiment. As shown in FIG. 10C, the channel-shaped stepped part 88*b* has the same function as the channel-shaped stepped part 70*a* in the first embodiment, and has an engaging part 88*c* that corresponds to the engaging part 71*a* of the hook part 71.

As is the case with the first embodiment, the driving nails 92*a* receive a driving force from the engaging part 88*c* of the channel-shaped stepped part 88*b*, whereby the rotary pick 92 rotates about a rotary shaft 91. The cam part 96 and the cam spring 93 serve to casue the rotary pick 92 to rotate substantially only in one direction (clockwise as viewed in FIG. 10A).

With the above described construction, in place of the reciprocating motion of the plungers 70 in the first embodiment, the swing arms 88 swing in the vertical direction. In the present embodiment, the relationship in operation between the channel-shaped stepped part 88*b* and the rotary pick 92 is the same as the relationship between the channel-shaped stepped part 70*a* and the rotary pick 66 in the first embodiment, and the two parts 88 and 92 make successive changes in motion in the same manner as shown in FIGS. 5A to 5H.

As shown in FIG. 8, in the housing 80, the swing arm unit SAU is supported at the base plate 81 thereof by a base holder 40. Below the swing arm unit SAU, resonant plates PLD, PLE, and PLF, which are rectangular in plan view, are disposed in layers in this order from the top. The resonant plates PLD, PLE, and PLF are supported at ends thereof in left and right directions as viewed in FIG. 8 by a pair of plate holders 45. The resonant plates PLD, PLE, and PLF have the same configuration as the resonant plates PLA, PLB, and PLC except the shape, but are designed so as to provide different sounding volumes from each other.

On a lower surface 81*a* of the base plate 81, vibration transmission mechanisms EMD, EME, and EMF are mounted in association with the resonant plates PLD, PLE, and PLF (the vibration transmission mechanisms EMD and EME are not shown). A short yoke 44 is mounted on the resonant plate PLF, and a damping plate 43 is stuck on the short yoke 44. The construction and function of each of the vibration transmission mechanisms EMD, EME, and EMF, the short yoke 44, and the damping plate 43 are the same as those in the first embodiment.

With this construction, one of the vibration transmission mechanisms EMD, EME, and EMF is selectively caused to operate to bring the swing arm unit SAU and one of the resonant plates PL into a coupled state, whereby the vibration of the reed 83 is transmitted to the resonant plate PL through the vibration transmission mechanism EM to generate sound. Thus, according to the present embodiment, the same effects as those in the first embodiment can be obtained.

Next, a third embodiment of the present invention will be described with reference to FIGS. 11 and 12.

In the third embodiment, vibration transmission mechanisms having a different construction from that in the first embodiment are employed, and other parts have the same constructions.

Figure 11:
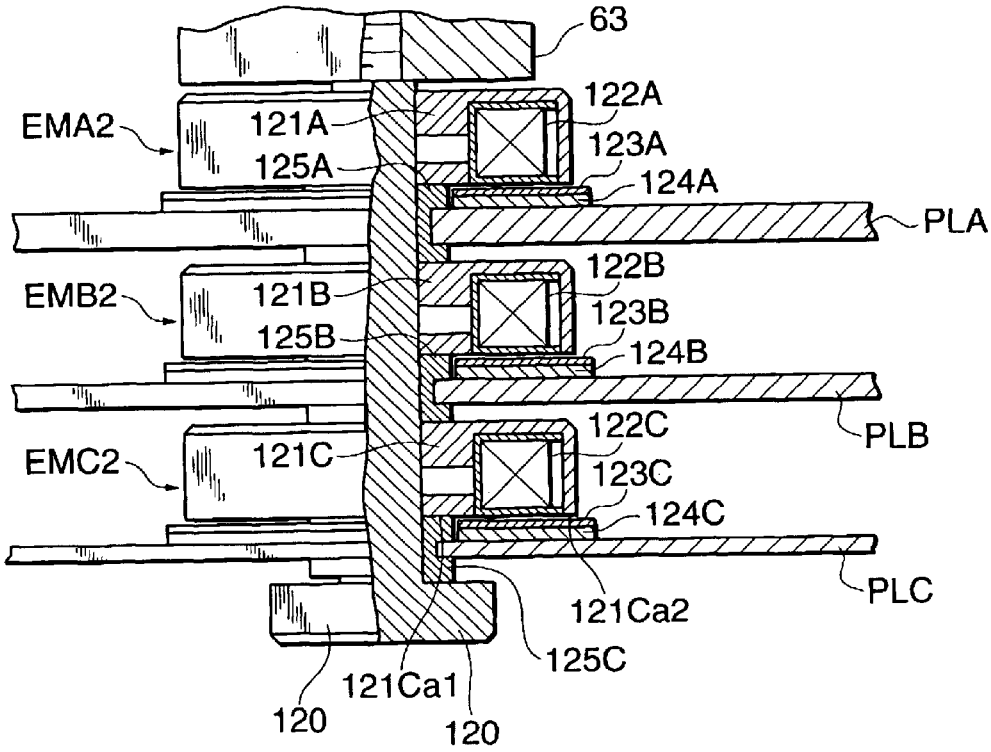
FIG. 11 is a fragmentary sectional view showing a performance apparatus according to a third embodiment of the present invention, showing in detail vibration transmission mechanisms and their associated parts.
Figure 12:
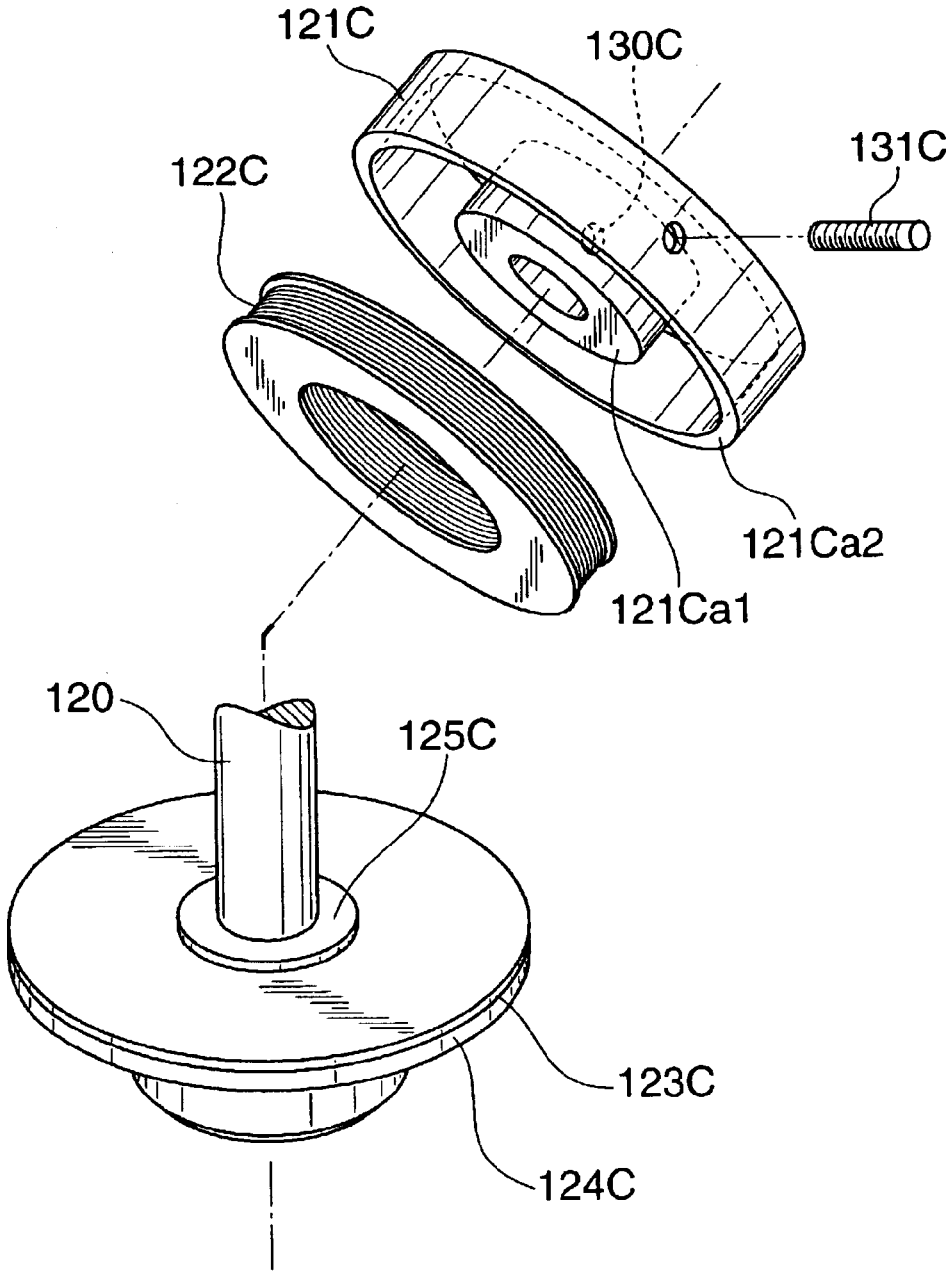
FIG. 12 is an exploded view showing one vibration transmission mechanism.

FIG. 11 is a fragmentary sectional view of a performance apparatus according to the third embodiment of the present invention, showing in detail the vibration transmission mechanisms and their associated parts. In the third embodiment, in place of the vibration transmission mechanisms EMA, EMB, and EMC in the first embodiment, vibration transmission mechanisms EMA2, EMB2, and EMC2 are provided. FIG. 12 is an exploded view of one vibration transmission mechanism EMC2.

As shown in FIG. 11, a center block 63 is placed in a fixed relationship with a plate center shaft 120, to which plate holders 125 (125A, 125B and 125C) are secured in association with respective resonant plates PLA, PLB, and PLC. The resonant plates PLA, PLB, and PLC are supported at their center parts by the plate holders 124A, 125B, and 125C, respectively. The plate holders 125 are made of hard rubber, elastomer, or the like, to thereby block vibration transmission between the plate center shaft 120 and the resonant plates PLA, PLB, and PLC.

The vibration transmission mechanisms EMA2, EMB2, and EMC2 are arranged around the plate center shaft 120 in association with the resonant plates PLA, PLB, and PLC. In the first embodiment, the clutch yokes 21 are shaped in the form of a horseshoe shape and the short yokes 24 and damping plates 23 are shaped in the form of a rectangle. However, in the third embodiment, taking the case of the vibration transmission mechanism EMC2 and elements associated therewith, a clutch yoke 121C, a clutch coil 122C, a short yoke 124C, and a damping plate 123C are all shaped in the form of a doughnut (see FIG. 12).

The clutch yoke 121C, which is made of a magnetic material, is fixed to the plate center shaft 120 such that a screw 131C threadedly fitted in a hole 130C in the yoke 121C is in pressure contact with the plate center shaft 120. Thus, vibration can be always transmitted between the plate center shaft 120 and the clutch yoke 121C. A clutch coil 122C is wound around the plate center shaft 120 in the clutch yoke 121C. On the short yoke 124C, which is made of a magnetic material and in the form of a doughnut-shaped plate, the damping plate 123C in the same shape is stuck. When the clutch coil 122C is deenergized, lower surfaces 121Ca1 and 121Ca2 of the clutch yoke 121C face the damping plate 123C in proximity thereto with a gap therebetween set to approximately 0.3 to 0.5 mm.

With this construction, when the clutch coil 122C is energized, the yoke 121C is adsorbed to the yoke 124C to bring the center block 63 and the resonant plate PLC into a coupled state through the plate center shaft 120 and the clutch yoke 121C. Then, the vibration of a reed 61 is transmitted through the center block 63, the plate center shaft 120, the clutch yoke 121C, the short yoke 124C, to the resonant plate PLC, whereby the resonant plate PLC vibrates. Except for the above operation, the performance apparatus according to the present invention has the same operations as those in the first embodiment.

The clutch yokes 121A and 121B, clutch coils 122A and 122B, damping plates 123A and 123B, and short yokes 124A and 124B of the other vibration transmission mechanisms EMA2 and EMB2 are constructed and arranged in the same manner as the clutch yoke 121C, clutch coil 122C, damping plate 123C, and short yoke 124C, respectively, and also the other associated parts are also constructed and arranged in the same manner.

According to the present embodiment, not only the same effects as those in the first embodiment but also the following effects can be provided. That is, the area of contact between the clutch yoke 121 and the damping plate 123 and the area of contact between the damping plate 123 and the short yoke 124 are so large that the vibration transmission mechanism EM has a stable attitude during vibration transmission, to thereby stably generate sound. Further, since the vibration transmission mechanisms EM are shaped in the form of a doughnut, a further vibration transmission path, that is, a path through the lower surface 121C*a*1 of the clutch yoke 121C, is also formed in the vicinity of the plate center shaft 120. As a result, the transmission efficiency of vibration from the reeds 61 is enhanced. Still further, the assemblage is easier due to the doughnut shape.

In the first to third embodiments, as part of vibration generating parts, actuators CYL1 and FLAT2, and reeds 61 and 83 are employed by way of example, but it is to be understood that the invention is not limited to these, and anything that generates vibration for sound producing can be employed. Also, the invention is not limited to those which vibrate based on performance data, but, for example, those which vibrate according to performance operation are applicable. Further, as a vibrating body that directly generates vibration, the reed has been described as an example, but the invention is not limited to this, and can be applied to sounding bodies which produces acoustic sound, in other words, those which generates sound by being mechanically excited, such as "strings" and "sound boards", including sounding bodies of metal, wood, or the like, in a plate shape.

What is claimed is:

1. A performance apparatus comprising:

at least one vibration generating part that generates vibration;

a plurality of sound boards;

a plurality of vibration transmission mechanisms interposed between respective ones of said plurality of sound boards and said vibration generating part in association with the respective ones of said plurality of sound boards, said plurality of vibration transmission mechanisms being operable to bring respective associated ones of said sound boards and said vibration generating part into a coupled state, to thereby transmit vibration of said vibration generating part to the respective associated ones of said sound boards; and an instruction device that gives an instruction selectively to one of said plurality of vibration transmission mechanisms to operate;

whereby vibration of said vibration generating part is transmitted to one of said sound boards that is coupled to said vibration generating part, to cause the one of said sound boards to vibrate to generate sound.

2. A performance apparatus according to claim 1, comprising a plurality of magnetic parts each provided on one of said vibration generating part and a corresponding one of said sound boards, and wherein:

said plurality of vibration transmission mechanisms each comprise one end and another end;

the one end of each of said vibration transmission mechanisms is fixedly mounted on the one of said vibration generating part and the corresponding one of said sound boards;

the other end of each of said vibration transmission mechanisms is disposed in proximity to a corresponding one of said magnetic parts;

whereby each of said vibration transmission mechanisms operates in response to the instruction from said instruction device, for having the other end thereof electromagnetically attracts the corresponding one of said magnetic parts, to bring said vibration generating part and the corresponding one of said sound boards into the coupled state.

3. A performance apparatus according to claim 2, comprising a plurality of damping parts, and wherein the other end of each of said vibration transmission mechanisms and the corresponding one of said magnetic parts have respective parts which face each other, and one of said damping parts is provided on at least one of the other end of each of said vibration transmission mechanisms and the corresponding one of said magnetic parts.

4. A performance apparatus according to claim 1, wherein said vibration generating part is operable based on performance data, for generating vibration, and said instruction device is responsive to a predetermined command corresponding to the performance data, for giving the instruction.

5. A performance apparatus according to claim 1, wherein said instruction device gives the instruction to each of said vibration transmission mechanisms to change strength of coupling of said vibration generating part and the corresponding one of said sound boards so as to adjust sounding volume.

6. A performance apparatus according to claim 1, wherein said instruction device gives the instruction to each of said vibration transmission mechanisms to change with time a degree of coupling of said vibration generating part and the corresponding one of said sound boards so as to provide a modulation effect while said vibration generating part is generating vibration.

7. A performance apparatus according to claim 1, further comprising an operation element operatable for causing said instruction device to give the instruction.

8. A performance apparatus according to claim 1, wherein when said instruction device gives instructions to said plurality of vibration transmission mechanisms to operate, said plurality of vibration transmission mechanisms are operated simultaneously to resonate a plurality of corresponding sound boards at the same time.

* * * * *